US006625903B2

(12) United States Patent
Swango et al.

(10) Patent No.: US 6,625,903 B2
(45) **Date of Patent: *Sep. 30, 2003**

(54) SHOE COVER WITH SLIP-RESISTANT SOLE

(75) Inventors: Lisa M. C. Swango, Alpharetta, GA (US); Timothy W. Reader, Suwanee, GA (US); Thomas H. Roessler, Menasha, WI (US); Franklin M. C. Chen, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 67 days.

This patent is subject to a terminal disclaimer.

(21) Appl. No.: 09/745,156

(22) Filed: Dec. 20, 2000

(65) Prior Publication Data

US 2001/0025433 A1 Oct. 4, 2001

Related U.S. Application Data

(63) Continuation of application No. 08/962,253, filed on Oct. 31, 1997, now Pat. No. 6,209,227.

(51) Int. Cl.[7] ..... A43B 3/16
(52) U.S. Cl. ..... 36/7.1 R; 36/9 R
(58) Field of Search ..... 36/7.1 R, 7.7, 36/7.5, 7.2, 9 R, 9 A

(56) References Cited

U.S. PATENT DOCUMENTS

| | | | |
|---|---|---|---|
| 2,700,161 A | | 1/1955 | Boyce |
| 2,710,366 A | | 6/1955 | Stern |
| 3,311,937 A | | 4/1967 | Conroy |
| 3,338,992 A | | 8/1967 | Kinney |
| 3,341,394 A | | 9/1967 | Kinney |
| 3,349,285 A | | 10/1967 | Belkin |
| 3,502,763 A | | 3/1970 | Hartmann |
| 3,542,615 A | | 11/1970 | Dobo et al. |
| 3,692,618 A | | 9/1972 | Dorschner et al. |
| 3,802,817 A | | 4/1974 | Matsuki et al. |
| 3,828,367 A | | 8/1974 | Bourgeois |
| 3,849,241 A | | 11/1974 | Butin et al. |
| 3,863,272 A | | 2/1975 | Guille |
| 3,898,750 A | | 8/1975 | Epstein |
| 3,909,009 A | | 9/1975 | Cvetko et al. |
| 3,981,088 A | | 9/1976 | Mitchell et al. |
| 4,019,265 A | | 4/1977 | Epstein |
| 4,022,456 A | | 5/1977 | Hooper et al. |
| 4,041,203 A | | 8/1977 | Brock et al. |
| 4,069,515 A | | 1/1978 | Swallow et al. |
| 4,081,301 A | | 3/1978 | Buell |
| 4,083,124 A | | 4/1978 | Michalak |
| 4,194,308 A | | 3/1980 | Karlsson |
| 4,224,935 A | | 9/1980 | Metelnick |
| 4,272,859 A | | 6/1981 | Vanhove |
| 4,296,499 A | | 10/1981 | Patterson et al. |
| 4,307,143 A | | 12/1981 | Meitner |
| 4,340,563 A | | 7/1982 | Appel et al. |
| 4,374,888 A | | 2/1983 | Bornslaeger |
| 4,427,408 A | | 1/1984 | Karami et al. |
| 4,516,336 A | | 5/1985 | Nissenbaum |
| 4,598,485 A | | 7/1986 | Joe et al. |
| 4,599,812 A | | 7/1986 | Harmsen |
| 4,616,428 A | | 10/1986 | Leger |
| 4,616,429 A | | 10/1986 | Alcala |
| 4,663,220 A | | 5/1987 | Wisneski et al. |
| 4,842,666 A | | 6/1989 | Werenicz |
| 4,847,934 A | | 7/1989 | Weber |
| 4,896,439 A | * | 1/1990 | Morgan ..... 36/7.5 |
| 4,918,839 A | | 4/1990 | Brandon |

(List continued on next page.)

FOREIGN PATENT DOCUMENTS

| | | |
|---|---|---|
| US | 1463863 | 2/1977 |

*Primary Examiner*—J. Mohandesi
(74) *Attorney, Agent, or Firm*—Dority & Manning, P.A.

(57) ABSTRACT

A shoe or foot covering with slip-resistant properties is disclosed. In particular, the foot covering includes slip-resistant portions made from a polymeric material that are preferably applied to the bottom surface of the foot covering. The polymeric material contains a metallocene catalyzed branch copolymer which has rubber-like properties.

16 Claims, 1 Drawing Sheet

U.S. PATENT DOCUMENTS 5,048,126 A 9/1991 McLaughlin
5,083,557 A 1/1992 Lennon et al.
5,133,088 A 7/1992 Dunlap
5,165,979 A 11/1992 Watkins et al.
5,169,706 A 12/1992 Collier et al.
5,204,174 A 4/1993 Daponte et al.
5,213,881 A 5/1993 Timmons et al.
5,218,723 A 6/1993 McLaughlin
5,228,215 A 7/1993 Bayer
5,597,194 A * 1/1997 Daugherty et al. ..... 296/39.2
5,697,106 A * 12/1997 Baker et al. ..... 2/239
5,763,337 A 6/1998 Montgomery
5,776,295 A * 7/1998 Montgomery ..... 156/324
5,822,884 A * 10/1998 Roeder ..... 36/59 C
6,209,227 B1 * 4/2001 Swango et al. ..... 36/7.1 R

* cited by examiner

SHOE COVER WITH SLIP-RESISTANT SOLE

REFERENCE TO RELATED APPLICATION

The present application is a continuation of U.S. application having Ser. No. 08/962,253 filed Oct. 31, 1997, now U.S. Pat. No. 6,209,227 B1.

FIELD OF THE INVENTION

The present invention is generally directed to garments, such as shoe covers, having slip-resistant properties.

BACKGROUND OF THE INVENTION

As is generally known, protective garments, such as surgical gowns, surgical drapes, and shoe covers (hereinafter collectively "surgical articles") have been designed to greatly reduce, if not prevent, the transmission through the surgical article of liquid and/or airborne contaminants. In surgical procedure environments, such liquid sources include the gown wearer's perspiration, patient liquids, such as blood, and life support liquids, such as plasma and saline. Examples of airborne contaminants include, but are not limited to, biological contaminants, such as bacteria, viruses and fungal spores. Such contaminants may also include particulate material such as lint, mineral fines, dust, skin squamae and respiratory droplets.

Many of these surgical articles were originally made of cotton or linen and were sterilized prior to their use in the operating room. In many instances, surgical articles fashioned from cotton or linen provide insufficient barrier protection from the transmission therethrough of airborne contaminants. Furthermore, these articles were costly, and, of course, laundering and sterilization procedures were required before reuse.

Disposable surgical articles, which also may require sterilization prior to their use, have largely replaced linen surgical articles. In some instances, such disposable surgical articles may be formed from nonwoven porous materials such as spunbond polypropylene or nonwoven laminates, such as spunbond/meltblown/spunbond laminates.

Some surgical articles, such as surgical gowns and drapes, are generally designed to loosely fit or overly the wearer. While surgical gowns and drapes are subjected to some pulling forces relative to the movement of the wearer, such gown and drapes generally are not subjected to the load bearing forces or abrupt pulling or shearing forces to which more form fitting surgical articles, such as shoe covers, may be subjected. As such, one challenge for the designers of form fitting surgical articles, such as shoe covers, is to sufficiently secure the seams in the fabric forming these articles such that these articles may withstand such load bearing, pulling and/or shearing forces.

Additionally, in the case of shoe covers, it is not uncommon for the operating room floor or hospital floors, which are generally smooth by design, to become spotted with the above described liquids which may be generated during a surgical procedure. As such, shoe cover designers are also challenged to design cost effective slip-resistant shoe covers.

In the past, shoe covers were coated with a traction adhesive, such as a hot melt adhesive, in order to provide the shoe cover with slip-resistant properties. The traction adhesives were typically sprayed, coated or printed on the shoe covers according to a particular pattern. Such adhesives have been found to be well suited for use with shoe covers made from nonwoven polymeric laminates, which, by themselves, provide limited traction.

Unfortunately, however, since hot melt adhesives are somewhat tacky, the adhesives have a tendency to become coated with dust and other fine particulates over time. Once coated with such particles, the adhesives begin to lose much of their anti-slip characteristics. Further, hot melt adhesives also tend to contaminate the machines that are used to produce the shoe covers.

As such, there is currently a need for a foot covering that has improved slip-resistant properties. More particularly, a need exists for a slip-resistant material for use on shoe covers that is less tacky than adhesives used in the past and that will not collect dust and other particulates during use. Such improved foot coverings are provided by the present invention and will become more apparent upon further review of the following specification.

SUMMARY OF THE INVENTION

The present invention recognizes and addresses the foregoing drawbacks and deficiencies of prior art constructions and methods.

Accordingly, it is an object of the present invention to provide an improved shoe cover having slip-resistant properties.

Another object of the present invention is to provide a shoe cover having slip-resistant portions applied to the bottom of the shoe cover that are made from a polymeric material that is less tacky than adhesives used in the past.

It is another object of the present invention to provide a shoe cover containing slip-resistant portions that are made from a polymer that grips and conforms tightly to a surface when compressed.

Still another object of the present invention is to provide a shoe cover containing slip-resistant portions that are made from a metallocene catalyzed polymer.

It is another object of the present invention to provide a shoe covering containing slip-resistant portions that are made from a metallocene catalyzed copolymer of ethylene and octene.

It is still another object of the present invention to provide a shoe cover having slip-resistant portions made from a polymeric material that has a relatively low elastic modulus and density at room temperature.

These and other objects of the present invention are achieved by providing a foot covering having slip-resistant properties. The foot covering includes a body having a shape configured to surround a foot or a shoe of a wearer. The body defines a bottom portion designed to contact the ground when the foot covering is being worn. At least one slip-resistant portion is secured to an outside surface of the body and is adapted to overlie the bottom portion. The slip-resistant portion comprises a polymeric material containing a metallocene catalyzed polymer.

More particularly, the metallocene catalyzed polymer can be a branched copolymer of a polyolefin. Preferably, the copolymer contains at least 30 branches per 1,000 carbon atoms. The metallocene catalyzed polymer can be, for instance, a copolymer of polypropylene or polyethylene and a hydrocarbon, such as an alkylene, having a carbon chain of at least 6 carbon atoms. Suitable hydrocarbons can be octene or hexene.

In one embodiment, the metallocene catalyzed polymer is a copolymer of polyethylene and octene. The copolymer can contain up to about 20% by weight octene. The copolymer can have an elastic modulus of from about $10^5$ dynes/cm$^2$ to about $10^7$ dynes/cm$^2$ and can have a glass transition temperature of from about −40° C. to about −70° C. The density of the polymer should be relatively low so that the polymer will conform to a surface when compressed. For example, the density of the polymer can range from about 0.6 grams per cubic centimeter to about 1.0 grams per cubic centimeter, and particularly from about 0.7 grams per cubic centimeter to about 0.95 grams per cubic centimeter.

The slip-resistant portions applied to the foot covering of the present invention can be made entirely from a metallocene catalyzed polymer or can contain other additives if desired. For instance, the slip-resistant portions can contain an adhesive mixed with the metallocene catalyzed polymer that is adapted to adhere the slip-resistant portions to the body of the foot covering. Besides adhesives, the slip-resistant portions can also contain other polymers, various fillers, and color additives. In general, the metallocene catalyzed polymer should be present within the slip-resistant portions in an amount of at least about 50% by weight.

The slip-resistant material of the present invention can be applied to the foot covering in any suitable manner. For instance, the slip resistant portions can be applied to the sole of the foot covering as a solid film or in a repeating pattern. In one embodiment, the slip-resistant portions can comprise a plurality of spaced apart strips.

The material that is used to form the body of the foot covering of the present invention is generally not critical. For instance, the foot covering can be made from a woven fabric, a nonwoven fabric, or from other materials. In one embodiment, the foot covering can be made from a laminate containing various layers of nonwoven polymeric webs. For example, the laminate can contain a nonwoven meltblown web placed in between a first nonwoven spunbond web and a second nonwoven spunbond web.

Other objects, features, and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
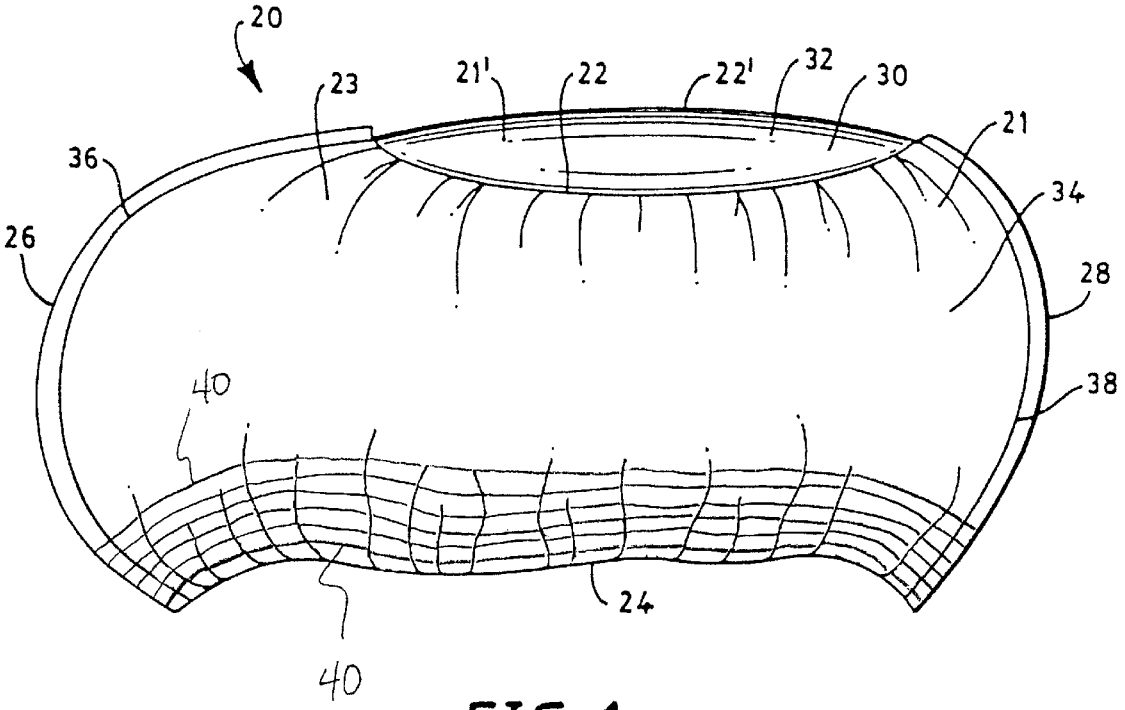
FIG. 1 is a side plan view of one embodiment of a shoe cover made in accordance with the present invention.

Repeat use of reference characters in the present specification and drawings is intended to represent same or analogous features or elements of the present invention.

Definitions

As used herein, the term "nonwoven fabric" refers to a fabric that has a structure of individual fibers or filaments which are interlaid, but not in an identifiable repeating manner.

As used herein the therm "spunbond fibers" refers to fibers which are formed by extruding a molten thermoplastic material as filaments from a plurality of fine, usually circular capillaries of a spinerette with the diameter of the extruded filaments then being rapidly reduced as by, for example, in U.S. Pat. No. 4,340,563 to Appel, et al., and U.S. Pat. No. 3,692,618 to Dorschner, et al., U.S. Pat. No. 3,802,817 to Matsuki, et al., U.S. Pat. Nos. 3,338,992 and 3,341,394 to Kinney, U.S. Pat. Nos. 3,502,763 and 3,909,009 to Levy and U.S. Pat. No. 3,542,615 to Dobo, et al. which are all herein incorporated by reference.

As used herein the term "meltblown fibers" refers to fibers formed by extruding a molten thermoplastic material through a plurality of fine, usually circular, die capillaries as molten threads or filaments into a high velocity, usually heated gas (e.g. air) stream which attenuates the filaments of molten thermoplastic material to reduce their diameter. Thereafter, the meltblown fibers are carried by the high velocity gas stream and are deposited on a collecting surface to form a fabric of randomly disbursed meltblown fibers. Meltblowing is described, for example, in U.S. Pat. No. 3,849,241 to Buntin, U.S. Pat. No. 4,307,143 to Meitner, et al., and U.S. Pat. No. 4,663,220 to Wisneski, et al. which are all herein incorporated by reference.

DETAILED DESCRIPTION OF PREFERRED EMBODIMENTS

It is to be understood by one of ordinary skill in the art that the present discussion is a description of exemplary embodiments only, and is not intended to limit the broader aspects of the present invention which broader aspects are embodied in the exemplary construction.

In general, the present invention is directed to shoe covers that have slip-resistant properties for providing traction to a wearer when the shoe covers are being worn on slippery surfaces. The shoe covers are made slip resistant according to the present invention by applying to the bottom of the shoe covers a rubber-like, elastomeric polymeric material. When compressed, the polymeric material conforms to an adjacent surface and provides the shoe cover with enhanced grip-like properties. Of particular advantage, the polymeric material of the present invention has a relatively high coefficient of friction without being as tacky and sticky as adhesives used in the past. Thus, the polymeric material of the present invention is less likely to adhere to and become contaminated with dirt and other particulate material.

The slip-resistant polymeric material that is applied to a shoe cover in accordance with the present invention for providing traction can be described generally, in one embodiment, as a thermoplastic polymer that has been catalyzed by a single site constrained geometry catalyst. For instance, the anti-slip polymer of the present invention can be a branched copolymer of a metallocene catalyzed polyolefin.

As used herein, a metallocene catalysis refers to a metal derivative of cyclopentadiene. A metallocene is a neutral, ancillary ligand stabilized transition metal complex and can have the following general formula:

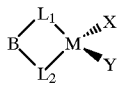

wherein:

$L_1$ is a cyclopentadienyl or substituted cyclopentadienyl moiety bonded to the metal through η-5 bonding $L_2$ is an organic moiety, which may or may not be a cyclopentadienyl moiety, strongly bonded to the metal which remains bonded to the metal during polymerization B is an optional bridging group that restricts the movement of $L_1$ and $L_2$ and that modifies the angle between $L_1$ and $L_2$ M is a metal such as, for instance, titanium or zirconium X and Y are halides or other organic moieties, such as methyl groups.

For instance, in one embodiment, metallocene can be as follows:

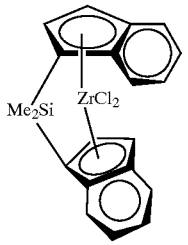

Metallocene is a catalyst that initiates polymerization of one or more monomers to form a polymer. Metallocene catalyzed polymers generally have a more uniform molecular weight distribution than polymers made using other types of conventional catalysts.

The polymer of the present invention, as described above, is preferably a branched copolymer of a polyolefin, such as a copolymer of polyethylene or polypropylene. In particular, it has been discovered that metallocene catalyzed branched copolymers are not as tacky or as sticky as adhesives used in the past. The polymers, however, have rubber-like properties that make the polymers well suited for anti-slip applications.

In one embodiment, the branched copolymer can be made from a copolymer of polyethylene or polypropylene and a hydrocarbon having a carbon chain of at least 6 carbon atoms. The molecular structure of these copolymers is such that the polyolefin forms a base chain from which the hydrocarbon branches off. In order for the polymer to have a minimal amount of tackiness, it is believed that the copolymers should have at least about 30 branches per 1,000 carbon atoms.

The hydrocarbon that is copolymerized with the polyolefin is preferably an alkylene. Suitable examples of hydrocarbons for use in the polymer include octene and hexene. In general, the hydrocarbon can be present in the copolymer in an amount up to about 20% by weight.

In one preferred embodiment of the present invention, the polymer is a metallocene catalyzed copolymer of ethylene and octene. For example, one commercially available ethylene-octene copolymer that may be used in the foot covering of the present invention is XU-58380.00 plastomer available from the Dow Chemical Company of Midland, Mich. XU-58380.00 polymer has a melt index of from about 8 to about 12 dg/min.

Besides having reduced tackiness, the branched copolymer of the present invention has rubber-like properties that provides the polymer with a high coefficient of friction. It is believed that the rubber-like properties can be attributed to the fact that the polymer has a relatively low elastic modulus and a relatively low density at room temperature. For instance, the polymer can have an elastic modulus of from about $10^5$ dynes/cm$^2$ to $10^7$ dynes/cm$^2$. The density of the polymer can range generally from about 0.6 grams per cubic centimeter to about 1.0 grams per cubic centimeter, particularly from about 0.7 grams per cubic centimeter to about 0.95 grams per cubic centimeter, and in one preferred embodiment can have a density of about 0.87 grams per cubic centimeter. The glass transition temperature of the polymer can range from about −40° C. to about −70° C.

By having a low elastic modulus and a low density, the polymer is compressible. More particularly, when pressed against a surface, such as when being worn on the bottom of a shoe cover, the polymer tightly conforms to the topography of the surface, which significantly increases the coefficient of friction between the polymer and the surface.

In general, the branched copolymer of the present invention can be applied to any suitable shoe or foot covering. Further, the polymer can be applied to the foot covering according to various different designs and patterns. For instance, the polymer can be applied to the foot cover as a continuous film or according to a repeating or nonrepeating pattern. For example, the polymer can be applied to the shoe cover in parallel strips, in a circular configuration, according to an arbitrary design, or according to any pattern that will provide the shoe cover with sufficient traction.

The shoe cover to which the branched copolymer is applied according to the present invention may be formed from a variety of materials and fabrics, such as woven, knit or nonwoven fabrics. For instance, in one embodiment, the shoe cover can be made from a woven or nonwoven polymeric fabric. Polymeric fabrics are particularly well suited for use in the construction of shoe covers that are designed to be worn in hospitals and other similar environments. For instance, such polymeric fabrics, and in particular such nonwoven polymeric fabrics, can be made according to a variety of processes including, but not limited to, air laying processes, wet laid processes, hydroentangling processes, spunbonding, meltblowing, staple fiber carding and bonding, and solution spinning. The fibers themselves can be made from a variety of dielectric materials including, but not limited to, polyesters, polyolefins, nylons and copolymers of these materials. The fibers may be relatively short, staple length fibers, typically less than 3 inches, or longer more continuous fibers such as are typically produced by a spunbonding process.

Nonwoven polymeric fabrics that may be used in the present invention can be formed from a single layer or multiple layers. In the case of multiple layers, the layers are generally positioned in a juxtaposed or surface-to-surface relationship and all or a portion of the layers may be bound to adjacent layers.

Commercially available nonwoven polymeric fabrics that may be used to construct the shoe covers of the present invention include the polypropylene nonwoven fabrics produced by the Assignee of record, Kimberly-Clark Corporation. For instance, in one embodiment, the nonwoven fabric can be a laminate including at least one ply formed from spunbond fibers and another ply formed from meltblown fibers, such as a spunbond/meltblown (SM) nonwoven laminate. In another embodiment, the nonwoven laminate may include at least one ply formed from meltblown fibers which is positioned between two plies formed from spunbond fibers, such as a spunbond/meltblown/spunbond (SMS) nonwoven laminate. Examples of these nonwoven laminates are disclosed in U.S. Pat. No. 4,041,203 to Brock, et al., U.S. Pat. No. 5,169,706 to Collier, et al., and U.S. Pat. No. 4,374,888 to Bornslaeger which are all herein incorporated by reference.

It should be noted, however, that materials other than nonwovens may be used. Examples of such other materials include wovens, films, foam/film laminates and combinations thereof, such as for example, a spunbond/film/spunbond (SFS) laminate.

The spunbond fibers may be formed from polypropylene. Suitable polypropylene for the spunbond layers is commercially available as PD-9355 from the Exxon Chemical Company of Baytown, Tex.

The meltblown fibers may be formed from polyolefin polymers, such as polypropylene and polybutylene or a blend thereof. Examples of such meltblown fibers are contained in U.S. Pat. Nos. 5,165,979 and 5,204,174 which are incorporated herein by reference. Desirably, the meltblown fibers may be formed from a blend of polypropylene and polybutylene wherein the polybutylene is present in the blend in a range of from about 0.5 percent to 20 percent by weight. One such suitable polypropylene is designated 3746-G from the Exxon Chemical Company of Baytown, Tex. One such suitable polybutylene is available as DP-8911 from the Shell Chemical Company of Houston, Tex. The meltblown fibers may also contain a polypropylene modified according to U.S. Pat. No. 5,213,881 which is incorporated herein by reference.

The SMS nonwoven laminate may be made by sequentially depositing onto a moving forming belt first a spunbond ply, then a meltblown ply and last another spunbond ply and then bonding the plies together to form the laminate. Alternatively, the plies may be made individually, collected in rolls, and combined in a separate bonding step. Such SMS nonwoven laminates usually have a basis weight of from about 0.1 to 12 ounces per square yard (osy) (3 to 400 grams per square meter (gsm)), or more desirably from about 0.75 to about 3 osy (25 to 100 gsm).

In order to adhere the polymer of the present invention to a fabric or material, the polymer can be heated above its softening temperature and then applied to the fabric or material. For instance, in one embodiment, the polymer can be extruded onto a fabric according to a particular design. During extrusion, the polymer can be heated to a temperature of about 390° F.

Once the polymer is applied to the fabric, if desired, the fabric can then be contacted with a roll, such as a nip roll, for further securing the polymer to the fabric. For instance, a nip roll at a pressure of about 60 psi can be placed in contact with the fabric. In this manner, the polymer is forced into the interstices of the fabric for creating a stronger bond between the two materials. The branched copolymer of the present invention may be applied to a shoe cover either alone or in combination with other additives and ingredients. For instance, in one embodiment, an adhesive may be combined with the polymer for forming a stronger bond between the polymer and the material that is used to construct the shoe cover. For example, when the shoe cover is made from a fabric, suitable adhesives that may be combined with the polymer include rosin derivatives, turpene resins such as oligomers of α and β pinenes, glycerol esters such as STAYBELITE ester available from Hercules, Inc., of Wilmington, Del. and Poly β pines such as PICOLYTE S70 also available from Hercules, Inc.

Besides adhesives, colorants may also be added to the polymer for aesthetic appeal or for any other purpose.

In a further embodiment, the branched copolymer can also be combined with other polymers as desired. For instance, polyethylene may be combined with the polymer in an amount up to about 50% by weight in order to alter the properties and characteristics of the polymer. In general, various other polymers and additives can be combined with the branched copolymer of the present invention as long as the copolymer comprises at least about 50% of the formulation that is applied to the shoe cover.

Referring now to the figure, one embodiment of a shoe cover made in accordance with the present invention is illustrated. The shoe cover illustrated in the figure is particularly well adapted for use in hospitals and other similar environments and can be made, for instance, from a nonwoven polymeric material. It should be understood, however, that the shoe cover illustrated in the figure merely represents one embodiment of the present invention. In general, it is believed that the anti-slip polymer of the present invention can be used with various other types of shoe and foot coverings.

Referring to FIG. 1, a shoe cover 20 is illustrated. The shoe cover 20 includes a body 23 formed by a pair of panels 21 and 21'. The panels 21 and 21' include a top edge 22 and 22', respectively. The top edges 22 and 22' define an opening 30 for receiving a sole (not shown) of a foot or a shoe. The panels 21 and 21' are joined along a common bottom edge 24 and side edges 26 and 28 forming seams 36 and 38 respectively. Each panel 21 and 21' includes an inside surface 32 and an outside surface 34.

The top edges 22 and 22' each include a strip of elastic material. In this way, the opening 30 is expandable so as to be form fitting about the wearer's ankle. The bottom edge 24 is also made expandable by being secured to another strip of elastic material. In this way, the shoe cover 20 fits snugly about the toe and heel portions of the sole.

In accordance with the present invention, shoe cover 20 further includes a plurality of slip-resistant portions or strips 40 located near bottom edge 24. As described above, strips 40 according to the present invention are made from a polymeric material containing a branched copolymer, such as a metallocene catalyzed copolymer. As shown in FIG. 1, in this embodiment, strips 40 are vertically oriented over the bottom surface of the shoe cover. It should be understood, however, that any suitable pattern may be applied to shoe cover 20.

Similarly, so that sufficient tractional forces may be formed between the inside surface 32 of the shoe cover 20 and the sole (not shown) of either the wearer's foot or shoe, a traction pattern may also be applied to the inside surface 32 of panels 21 and/or 21' near the bottom edge 24. The traction pattern applied to the inside surface 32 may be similar to the traction pattern 40 which is applied to the outside surface 34.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A foot covering comprising:

a body have a shape configured to surround a foot of a wearer, said body defining a bottom portion designed to contact the ground when said foot covering is being worn; and at least one slip-resistant portion secured to an outside surface of said bottom portion, said slip-resistant portion comprising an elastomeric polymer, said polymer comprising a metallocene catalyzed polyethylene or a metallocene catalyzed polypropylene, said polymer having a density of from about 0.7 grams per cubic centimeter to about 0.95 grams per cubic centimeter, the polymer further having an elastic modulus of from about $10^5$ dynes/cm$^2$ to about $10^7$ dynes/cm$^2$, the polymer being compressible such that the slip-resistant portion conforms to an adjacent surface when compressed.

2. A foot covering as defined in claim 1, wherein said polymer comprises a metallocene catalyzed copolymer of polyethylene or polypropylene and an alkylene having a carbon chain of at least 6 carbon atoms.

3. A foot covering as defined in claim 1, wherein said polymer comprises a copolymer of ethylene and octene.

4. A foot covering as defined in claim 3, wherein said octene is present within said copolymer in an amount up to about 20% by weight.

5. A foot covering as defined in claim 1, wherein said at least one slip-resistant portion comprises a plurality of strips attached to said bottom portion of said body.

6. A foot covering as defined in claim 1, wherein said body of said foot covering is made from a nonwoven polymeric fabric.

7. A foot covering as defined in claim 1, wherein said polymer comprises a metallocene catalyzed copolymer.

8. A foot covering as defined in claim 1, wherein said polymer is applied to said bottom portion of said body according to a repeating pattern.

9. A foot covering comprising:

a body having a shape configured to surround a foot of a wearer, said body defining a bottom portion designed to contact the ground when said foot covering is being worn; and at least one slip-resistant portion secured to an outside surface of said bottom portion, said slip-resistant portion comprising an elastomeric polymer, said polymer comprising a metallocene catalyzed copolymer of ethylene or propylene and an alkylene, said polymer having a density of from about 0.7 grams per cubic centimeter to about 0.95 grams per cubic centimeter and having an elastic modulus of from about $10^5$ dynes/cm$^2$ to about $10^7$ dynes/cm$^2$, the polymer being compressible such that the slip resistant portion conforms to an adjacent surface when compressed.

10. A foot covering as defined in claim 9, wherein said polymer comprises a metallocene catalyzed copolymer of polyethylene or polypropylene and an alkylene having a carbon chain of at least 6 carbon atoms.

11. A foot covering as defined in claim 9, wherein said polymer comprises a copolymer of ethylene and octene.

12. A foot covering as defined in claim 11, wherein said octene is present within said copolymer in an amount up to about 20% by weight.

13. A foot covering as defined in claim 9, wherein said at least one slip-resistant portion comprises a plurality of strips attached to said bottom portion of said body.

14. A foot covering as defined in claim 9, wherein said body of said foot covering is made from a nonwoven polymeric fabric.

15. A foot covering as defined in claim 9, wherein said polymer comprises a metallocene catalyzed copolymer.

16. A foot covering as defined in claim 9, wherein said polymer is applied to said bottom portion of said body according to a repeating pattern.

* * * * *